US005690470A

United States Patent [19]

Zimmer

[11] Patent Number: 5,690,470

[45] Date of Patent: Nov. 25, 1997

[54] BLOWER HOUSING AND APPARATUS FOR ASSEMBLY THEREOF

[75] Inventor: Donald N. Zimmer, Marshalltown, Iowa

[73] Assignee: Lennox Industries Inc., Richardson, Tex.

[21] Appl. No.: 739,178

[22] Filed: Oct. 30, 1996

[51] Int. Cl.[6] ..... F01D 25/24

[52] U.S. Cl. ..... 415/214.1

[58] Field of Search ..... 415/206, 214.1, 415/215.1

[56] References Cited

U.S. PATENT DOCUMENTS

| | | | |
|---|---|---|---|
| 3,223,313 | 12/1965 | Kinsworthy | 415/206 |
| 3,332,612 | 7/1967 | Gross | 415/206 |
| 3,619,080 | 11/1971 | Bullock | 415/214.1 |
| 3,732,030 | 5/1973 | Mullings | 415/214.1 |
| 3,775,029 | 11/1973 | Ranz | 415/206 |
| 4,787,818 | 11/1988 | Bales et al. | 415/206 |
| 5,158,432 | 10/1992 | Cox | 415/214.1 |

*Primary Examiner*—John T. Kwon

*Attorney, Agent, or Firm*—W. Kirk McCord

[57] ABSTRACT

A housing for an air blower is assembled by providing first and second panels having respective first and second curved edges and a third panel having opposed first and second flanges. The first and second flanges define respective elongated first and second channels on opposite sides of the third panel. The third panel is wrapped around the first and second panels so that the first and second curved edges are received within the first and second channels, respectively, and the third panel spans between the first and second panels. Concurrently with the wrapping step, the first and second flanges are scored at selected intervals therealong, to secure the third panel to the first and second panel.

13 Claims, 9 Drawing Sheets

BLOWER HOUSING AND APPARATUS FOR ASSEMBLY THEREOF

TECHNICAL FIELD

This invention relates generally to air blowers used in air conditioners, furnaces and the like, and in particular to an improved air blower housing and method of assembly thereof.

BACKGROUND ART

Air blowers are typically used in air conditioners, furnaces and the like to move a volume of air through a heat exchanger, whereby heat is either added to or removed from the air stream, to supply conditioned air to an indoor space. Such air blowers are typically motor-driven and are mounted within a metal housing located in an air handler section of an air conditioning or heating system.

According to prior practice, a blower housing is assembled by wrapping an elongated metal panel around respective curved edges of two other metal panels which are retained in generally parallel relationship, such that the wrapped panel spans between the two parallel panels to form the blower housing.

In accordance with one prior art method of assembly, opposed side flanges of the wrapped panel are spot-welded to the respective parallel panels after the wrapping process to secure the wrapped panel to the two parallel panels. The spot welding requires the further step of painting the assembled housing.

In accordance with another prior art assembly method, attachment screws are used to secure the wrapped panel to the two parallel panels after the wrapping step and a punch tool is used to make dimples in the opposed side flanges of the wrapped panel between the screws to further secure the wrapped panel to the parallel panels.

A major disadvantage of prior art blower housing assembly methods is that multiple steps are required in the assembly process. Another problem associated with prior art blower housings is that of excessive vibration along the seams where the wrapped panel is joined to the other two panels. There is, therefore, a need for an improved air blower housing which is not susceptible to vibration along the seams where the panels are joined. There is also a need for a faster and more economical method of assembling an air blower housing.

SUMMARY OF THE INVENTION

In accordance with the present invention, an air blower housing is assembled by providing first and second panels having respective first and second curved edges and a third panel having opposed first and second flanges. The first flange defines a first channel on one side of the third panel and the second flange defines a second channel on an opposite side of the third panel. The method further includes the steps of positioning the first and second panels in spaced parallel relationship; positioning one end of the third panel below the first and second panels; and wrapping the third panel around the first and second panels so that the first and second curved edges are received within the first and second channels, respectively, the first flange overlaps the first curved edge, the second flange overlaps the second curved edge and the third panel spans between the first and second panels. In accordance with a feature of the invention, concurrently with the wrapping step, the third panel is secured to the first panel generally along the first curved edge and to the second panel generally along the second curved edge.

In accordance with a preferred embodiment of the invention, the first and second flanges are scored at selected intervals therealong. The scoring step occurs concurrently with the wrapping step, thereby significantly reducing assembly time and cost. The scoring step is accomplished by mounting first and second scoring tools on a wrapper arm which is used to wrap the third panel around the first and second panels. The first scoring tool includes a first roller having a reduced diameter first intermediate portion defining a first annular groove, which is adapted to receive the first flange and the first curved edge for guiding the first roller along the first curved edge. Similarly, the second scoring tool includes a second roller having a reduced diameter second intermediate portion defining a second annular groove, which is adapted to receive the second flange and the second curved edge for guiding the second roller along the second curved edge.

The first roller carries plural first scoring members. A first actuating member (preferably a rotatable first cam) is provided for sequentially actuating the first scoring members, whereby each of the first scoring members impacts the first flange to score the first flange at selected intervals therealong. The second roller carries plural second scoring members. A second actuating member (preferably a rotatable second cam) is provided for sequentially actuating the second scoring members, whereby each of the second scoring members impacts the second flange to score the second flange at selected intervals therealong. The first roller is held in pressure engagement with the first flange and first curved edge and the second roller is held in pressure engagement with the second flange and the second curved edge by pressure means, which preferably includes an air-driven piston.

The blower housing assembled according to the aforementioned process is characterized by the third panel (i.e., the wrapped panel) being joined to the first and second panels along respective curved seams generally parallel to the first and second curved edges. The seams are secured by scoring respective outwardly facing surfaces of the first and second flanges proximate to respective distal edges thereof, whereby the first flange is staked to the first panel and the second flange is staked to the second panel. The resulting seams are substantially resistant to vibration, which reduces blower noise during operation.

BEST MODE FOR CARRYING OUT THE INVENTION

The best mode for carrying out the invention will now be described with reference to the accompanying drawings. Like parts are marked with the same respective reference numbers throughout the specification and the drawings. The drawings are not necessarily to scale and in some instances proportions may have been exaggerated in order to more clearly depict certain features of the invention.

Figure 1:
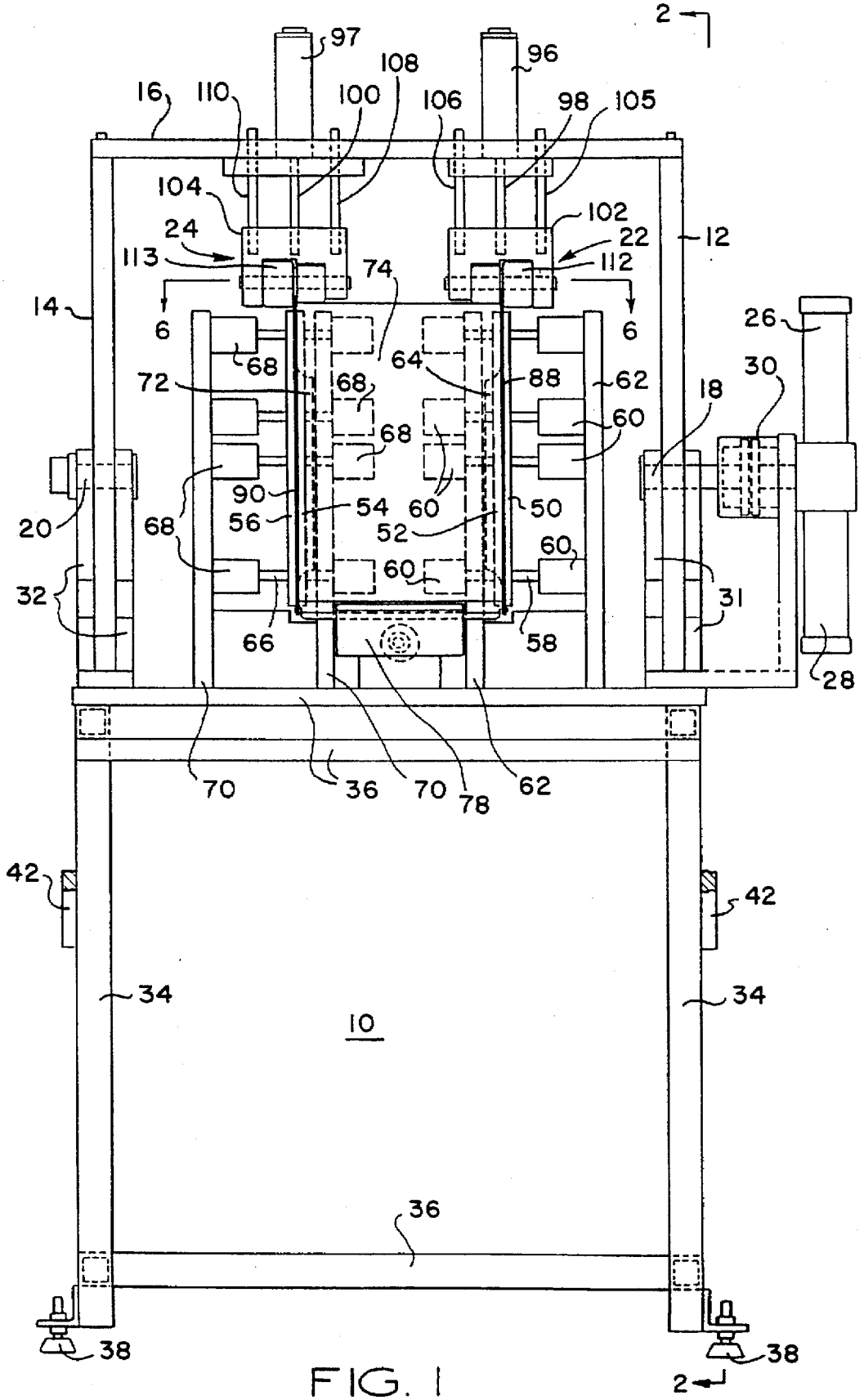
FIG. 1 is a front elevation view of an apparatus for assembling an air blower housing, according to the present invention.
Figure 2:
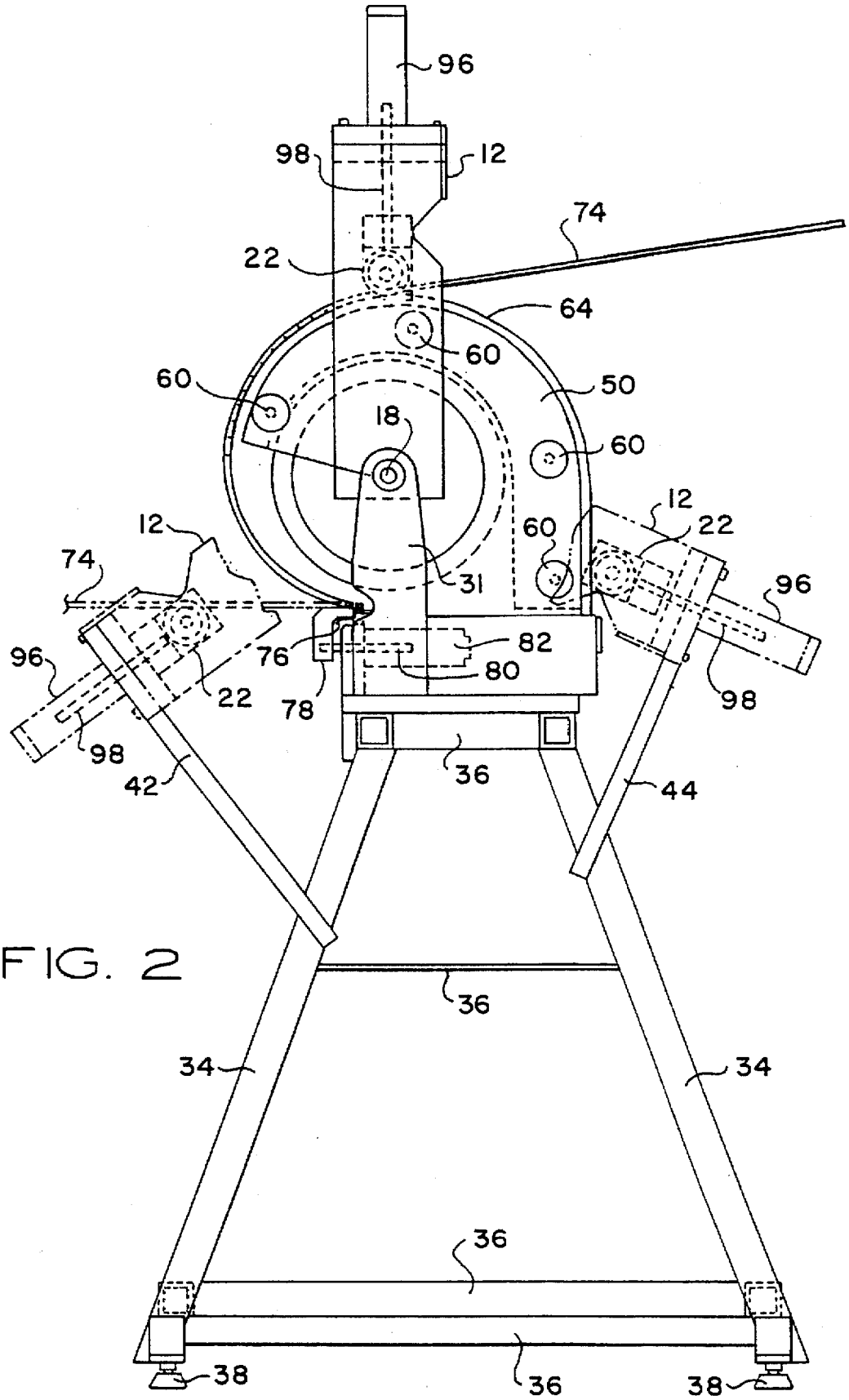
FIG. 2 is a sectional view thereof, taken along the line 2—2 of FIG. 1.

Referring to FIGS. 1 and 2, an apparatus 10 for assembling an air blower housing is depicted. Apparatus 10 includes a wrapping mechanism comprised of opposed arms 12, 14 and a cross-member 16 extending between arms 12 and 14. Arms 12, 14 are mounted for pivotal movement about respective mounting pins 18, 20. First and second scoring tools 22, 24 are carried on cross-member 16. A hydraulic rotary actuator, which includes hydraulic cylinders 26, 28 and a drive coupling 30, is provided for operating the wrapping mechanism, whereby arms 12, 14 are pivoted about respective mounting pins 18, 20. Mounting pins 18, 20 are carried in respective uprights 31, 32. Apparatus 10 further includes four inclined support legs 34 and plural horizontal support members 36. A support foot 38 is located on the bottom of each leg 34.

As can best be seen in FIG. 2, positioned on each side of apparatus 10 are two stop members 42, 44, which limit the pivoting movement of arms 12, 14 by engaging cross-member 16. One of the stop members 42 and one of the stop members 44 have a limit switch (not shown), which de-activates the hydraulic rotary actuator in response to the corresponding limit switch being contacted by cross-member 16. In FIG. 2, only one side of apparatus 10 is shown, so that only scoring tool 22 and one pair of stop members 42, 44 are visible. However, one skilled in the art will recognize that there is another pair of stop members 42, 44 on an opposite side of apparatus 10.

Apparatus 10 is operable to assemble three metal panels (two scroll panels and one wrapper panel) into a housing for an air blower used in an air conditioning or heating system, according to the following process. As can best be seen in FIG. 1, apparatus 10 includes parallel clamping plates 50, 52, 54, 56. Plates 50, 52 are operable by eight reciprocally movable pistons 58 emanating from respective eight hydraulic cylinders 60 mounted on uprights 62, to clamp a first panel 64 (a first scroll panel) in a fixed position between plate 50 and plate 52. Plates 54, 56 are operable by eight reciprocally movable pistons 66 emanating from respective eight hydraulic cylinders 68 mounted on uprights 70, to clamp a second panel 72 (a second scroll panel) between plate 54 and plate 56 and in parallel relationship with first panel 64. The spacing between panels 64 and 72 is adjustable by moving scoring tool 24 horizontally along cross-member 16 and by moving uprights 70 horizontally. Scoring tool 22 and uprights 62 stay fixed. A third panel 74 (a wrapper panel) is positioned horizontally with a first end thereof below first and second panels 64, 72, as can best be seen in FIG. 2. Third panel 74 has a protruding lip 76 at the first end thereof. A retaining member 78 is operable by a reciprocally movable piston 80 emanating from an air cylinder 82, to engage lip 76 and retain third panel 74 in a fixed position. One skilled in the art will recognize that apparatus 10 includes numerous other components, including hydraulic pumps and electrical control components, which are not illustrated.

Referring also to FIGS. 9–12, after lip 76 has been engaged by retaining member 78, four screws 84, 85, 86, 87 are used to attach third panel 74 to first and second panels 64, 72, proximate to the first end of third panel 74. Screws 84, 85 attach third panel 74 to first panel 64 and screws 86, 87 attach third panel 74 to second panel 72. Third panel 74 has opposed tabs 89, 91, proximate to lip 76. Third panel 74 also has opposed first and second flanges 88, 90 extending substantially the entire length of third panel 74 from the first end thereof to an opposed second end thereof. Flanges 88, 90 are generally U-shaped to define respective U-shaped channels 92, 93. As can best be seen in FIGS. 9 and 10, screw 84 attaches tab 89 to first panel 64 and screw 85 attaches flange 88 to first panel 64. Screw 86 attaches tab 91 to second panel 72 and screw 87 attaches flange 90 to second panel 72. When third panel 74 is positioned with its first end below first and second panels 64, 72, an outwardly facing first curved edge 94 of first panel 64 is received within first channel 92 and an outwardly facing second curved edge 95 of second panel 72 is received within second channel 93.

After screws 84, 85, 86, 87 have been applied to secure third panel 74 to first and second panels 74, 72, as described hereinabove, the next step in the assembly process is to wrap third panel 74 around first and second panels 64, 72, as can best be seen in FIG. 2. Wrapping is accomplished by positioning arms 14, 16 and cross-member 20 in the position illustrated on the left side of FIG. 2, with cross-member 20 in contact with stop members 42 on both sides of apparatus 10. Scoring tools 22, 24 are positioned in contact with first and second flanges 88, 90, respectively. With scoring tools 22, 24 so positioned, arms 14, 16 are rotated clockwise (as viewed in FIG. 2) by the hydraulic rotary actuator to wrap third panel 74 around first and second panels 64, 72. First and second scoring tools 22, 24 are held in pressure engagement with respective flanges 88, 90 by respective pneumatic cylinders 96, 97 and respective reciprocally movable pistons 98, 100 during most of the wrapping cycle, so that first curved edge 94 is received within first channel 92 along substantially the entire length of first curved edge 94 and second curved edge 95 is received within second channel 93 along substantially the entire length of second curved edge 95. A proximity switch is used to activate pistons 98, 100. At the onset of each wrapping cycle, pistons 98, 100 are retracted so that tools 22, 24 are in relatively loose contact with flanges 88, 90, respectively. When arms 14, 16 reach a predetermined position, they are detected by the proximity switch, which activates pistons 98, 100 to hold tool 22 in pressure engagement with first flange 88 and first curved edge 94 and to hold tool 24 in pressure engagement with second flange 90 and second curved edge 95, whereupon the scoring operation is activated, as described in greater detail hereinafter.

The pneumatic pressure within cylinder 96 holds piston 98 in pressure engagement with a block 102 in which the major components of scoring tool 22 are carried. Guide pins 105, 106 (FIG. 1) limit the movement of block 102 along an axis parallel to respective major axes of guide pins 104, 106. Similarly, the pneumatic pressure within cylinder 97 holds piston 100 in pressure engagement with a block 104 in which the major components of scoring tool 24 are carried. Guide pins 108, 110 are provided for limiting the movement of block 104 to movement along an axis parallel to respective major axes of guide pins 108, 110.

Figure 3:
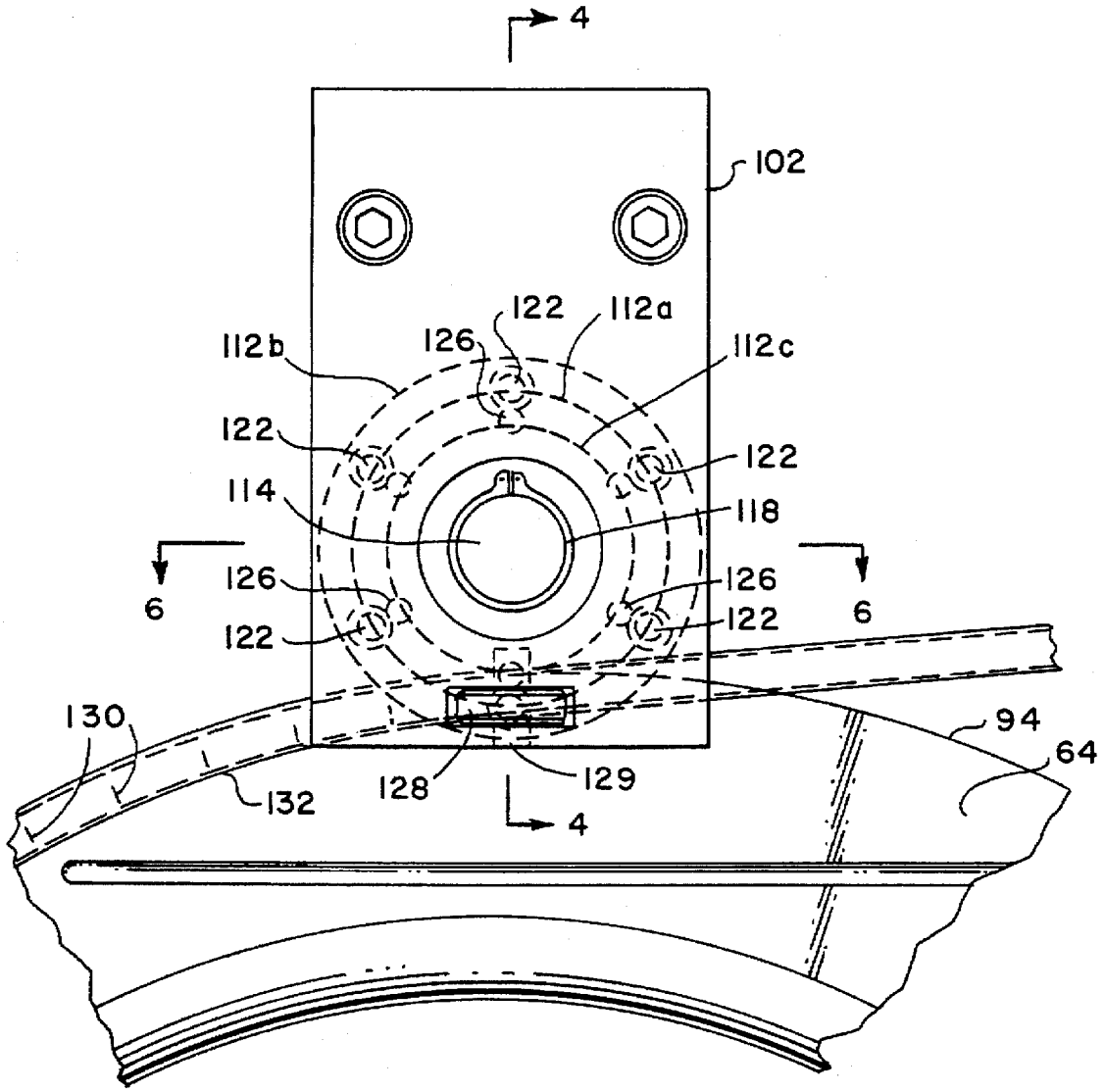
FIG. 3 is a detailed side view, illustrating the assembly of the blower housing.
Figure 5:
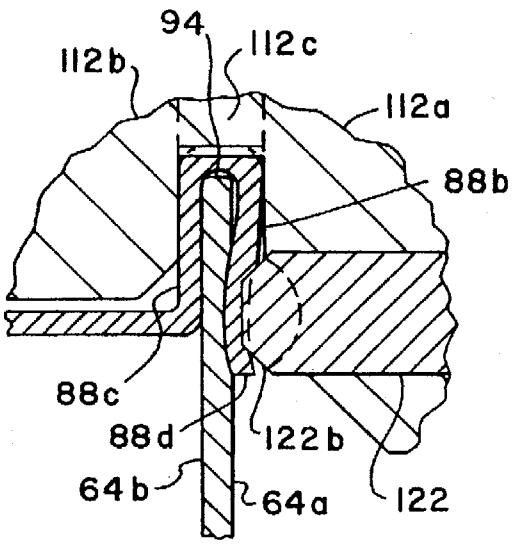
FIG. 5 is a detailed view, illustrating the scoring operation part of the blower assembly process.
Figure 4:
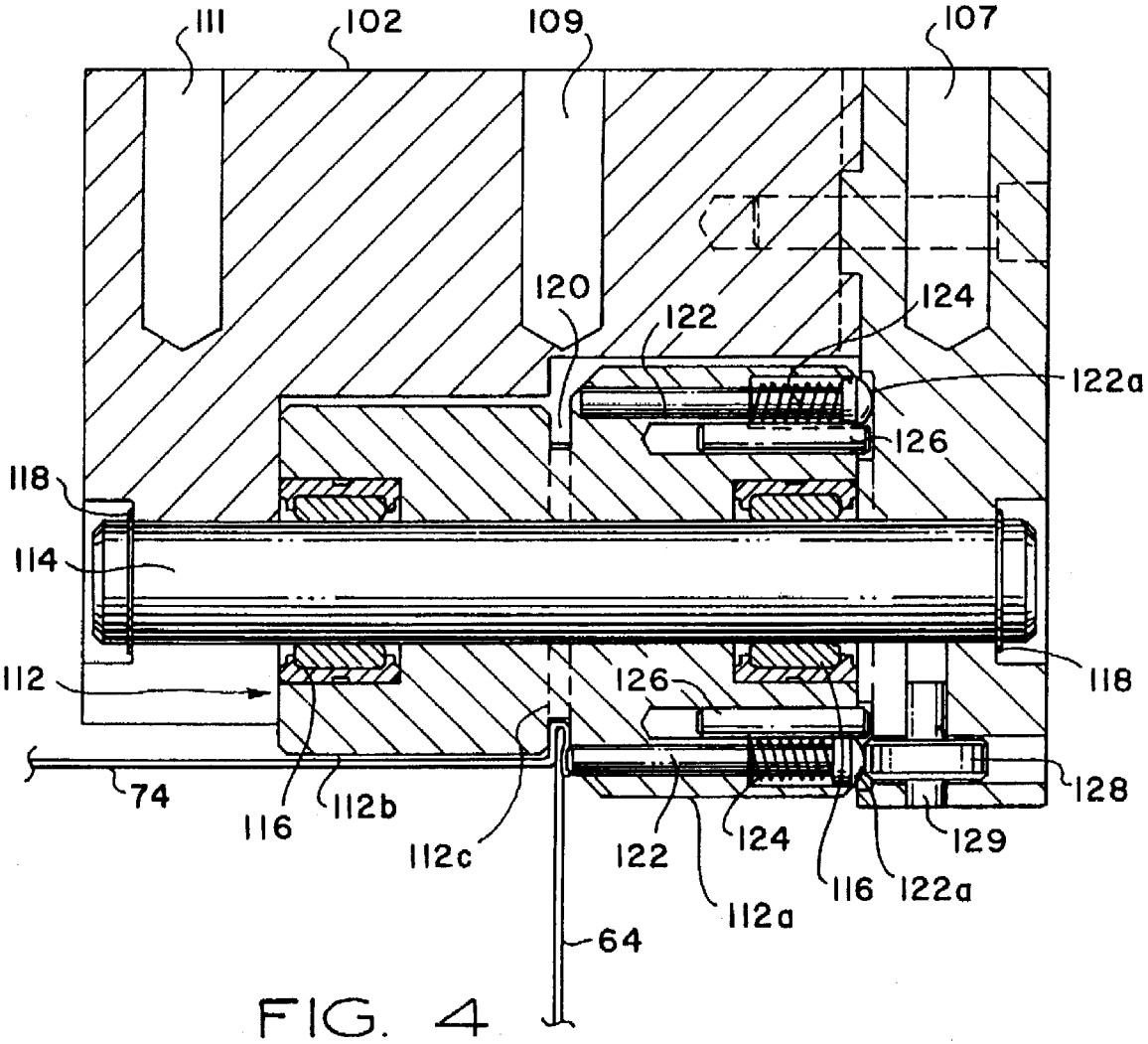
FIG. 4 is a sectional view, taken along the line 4—4 of FIG. 3.

Scoring tools 22, 24 and their operation will now be described in greater detail with reference to FIGS. 3–6. Although only scoring tool 22 is shown in FIGS. 3–5, scoring tool 24 is configured identically to scoring tool 22. Carried within block 102 is a roller 112 mounted for rotation about a fixed shaft 114. Roller 112 has two roller bearings 116 to allow roller 112 to rotate about shaft 114. Shaft 114 is retained within block 102 by retaining rings 118, as can be best seen in FIG. 4. Roller 112 has first and second end portions 112*a*, 112*b*, respectively, and a reduced diameter intermediate portion 112*c*, which defines a groove 120. When tool 22 is positioned in contact with flange 88, as previously described, flange 88 is received within groove 120 and is in contact with intermediate portion 112*c*. As can be best seen in FIG. 6, an outer surface of intermediate portion 112*c* is knurled. Block 102 includes relief portions 107, 109, 111 to accommodate movement of guide pin 105, piston 98 and guide pin 106, respectively (see FIG. 1).

Figure 6:
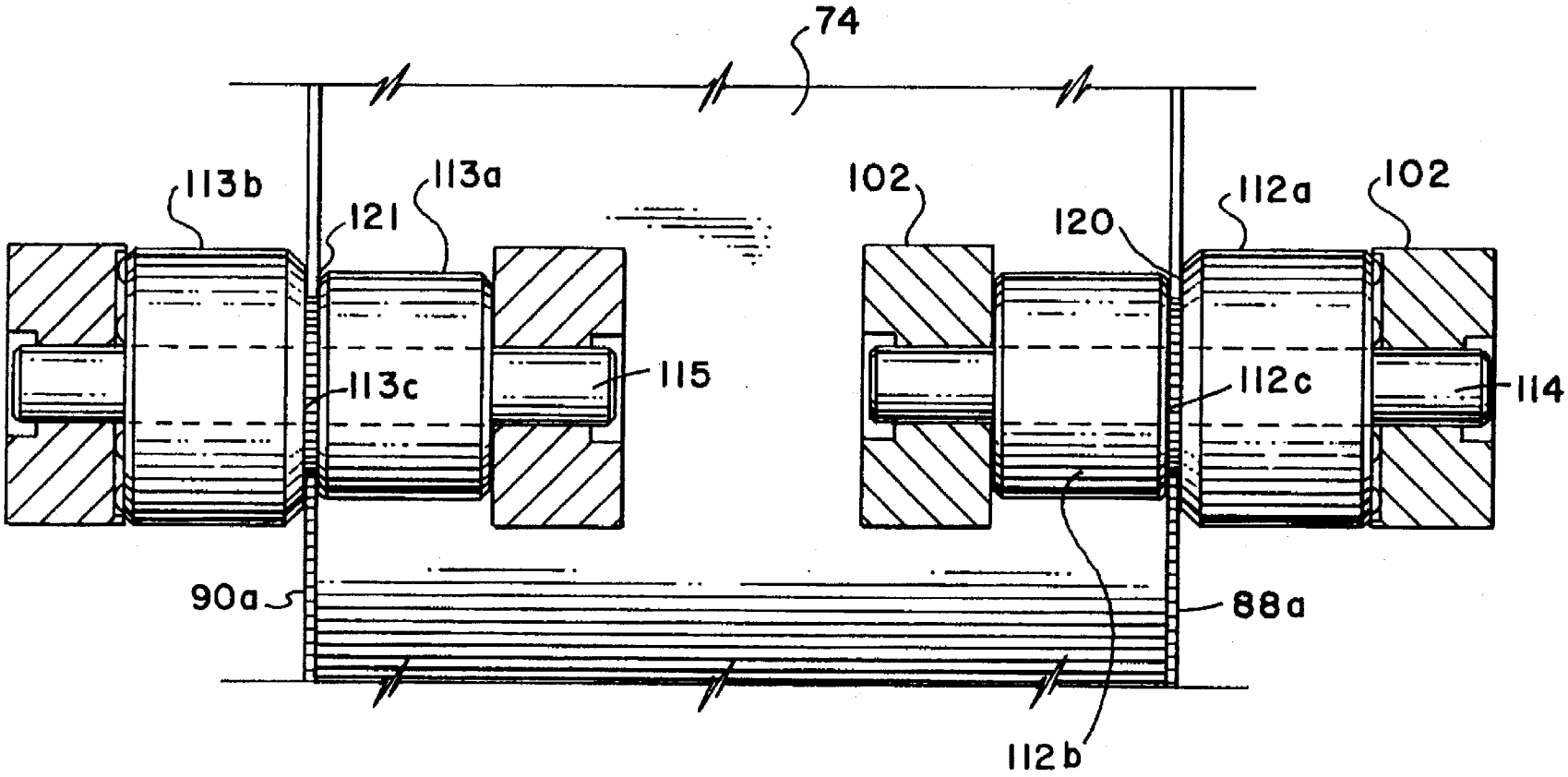
FIG. 6 is a sectional view, taken along the line 6—6 of FIG. 1.

Carried within block 104 is a roller 113 mounted for rotation about a fixed shaft 115, as can be best seen in FIGS. 1 and 6. Although not shown in the drawings, roller 113 has two roller bearings to allow it to rotate about shaft 115. Shaft 115 is retained within block 104 by retaining rings (not shown) similar to rings 118. Roller 113 has first and second end portions 113*a*, 113*b*, respectively, and a reduced diameter intermediate portion 113*c*, which defines a groove 121. When tool 24 is positioned in contact with flange 90, as previously described, flange 90 is received within groove 121 and is in contact with intermediate portion 113*c*. As can be best seen in FIG. 6, an outer surface of intermediate portion 113*c* is knurled.

As third panel 74 is wrapped around first and second panels 64, 72, roller 112 rotates about shaft 114 and travels along flange 88, and roller 113 rotates about shaft 115 and travels along flange 90. The rotation of roller 112 knurls an outer surface 88*a* of flange 88, as roller 112 travels along flange 88, and the rotation of roller 113 knurls an outer surface 90*a* of flange 90, as roller 113 travels along flange 90.

Carried within end section 112*a* are six scoring members 122, which are biased by respective spring members 124 to a retracted position illustrated by the upper one of the two scoring members 122 in FIG. 4. Each scoring member 122 has an enlarged head 122*a* with a slot (not shown) in mating engagement with a corresponding guide pin 126. Engagement between the head slot of each scoring member 122 and the corresponding guide pin 126 constrains each scoring member 122 to movement along a major axis of the corresponding scoring member 122.

As roller 112 rotates, head 122*a* of each scoring member 122 contacts a cam 128 in a bottom portion of block 102. Cam 128 is rotatable about a shaft 129. Contact with cam 128 causes the corresponding scoring member 122 to be thrust forward approximately 0.027 inch, such that a trapezoidal-shaped tip 122*b* of the corresponding scoring member 122 impacts an outwardly facing surface 88*b* of flange 88. As shown in FIG. 5, this impact displaces flange 88 into an outwardly facing surface 64*a* of first panel 64. The impact force is sufficient to displace surface 64*a* slightly inwardly. The impact also leaves an elongated scoring mark 130 (see FIG. 3) on surface 88*b*. Each scoring member 122 contacts cam 128 when it reaches the bottom dead center position of the rotation of roller 112, as best seen in FIG. 4. End section 112*b* contacts an inwardly facing surface 88*c* of flange 88 and cooperates with each scoring member 122 as it impacts surface 88*b* to pinch flange 88 against opposed surfaces 64*a*, 64*b* of first panel 64. End section 112*b* provides a support backing to limit the displacement of flange 88 so that flange 88 is subject to the full force of the impact of each scoring member 22. The slight displacement of flange 88 into surface 64*a* effected by scoring marks 130 securely stake third panel 74 to first panel 64 along a seam 132 defined by a distal edge 88*d* of flange 88 and surface 64*a*. The resulting seam 132 is substantially resistant to vibration during air blower operation.

Although not shown in the drawings, six scoring members are also carried within end section 113*a* and scoring of flange 90 is accomplished concurrently with scoring of flange 88. One skilled in the art will recognize the scoring operation is effected by rotation of rollers 112, 113 and that rollers 112, 113 do not rotate until they are held in the pressure engagement with flanges 88, 90, respectively, by respective pistons 98, 100.

Figure 7:
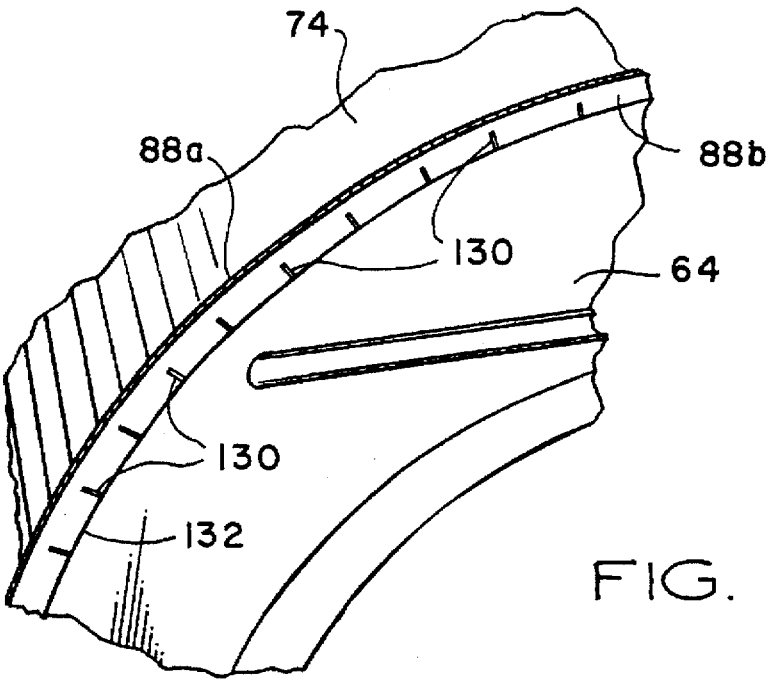
FIG. 7 is a perspective view of a portion of the assembled blower housing.
Figure 8:
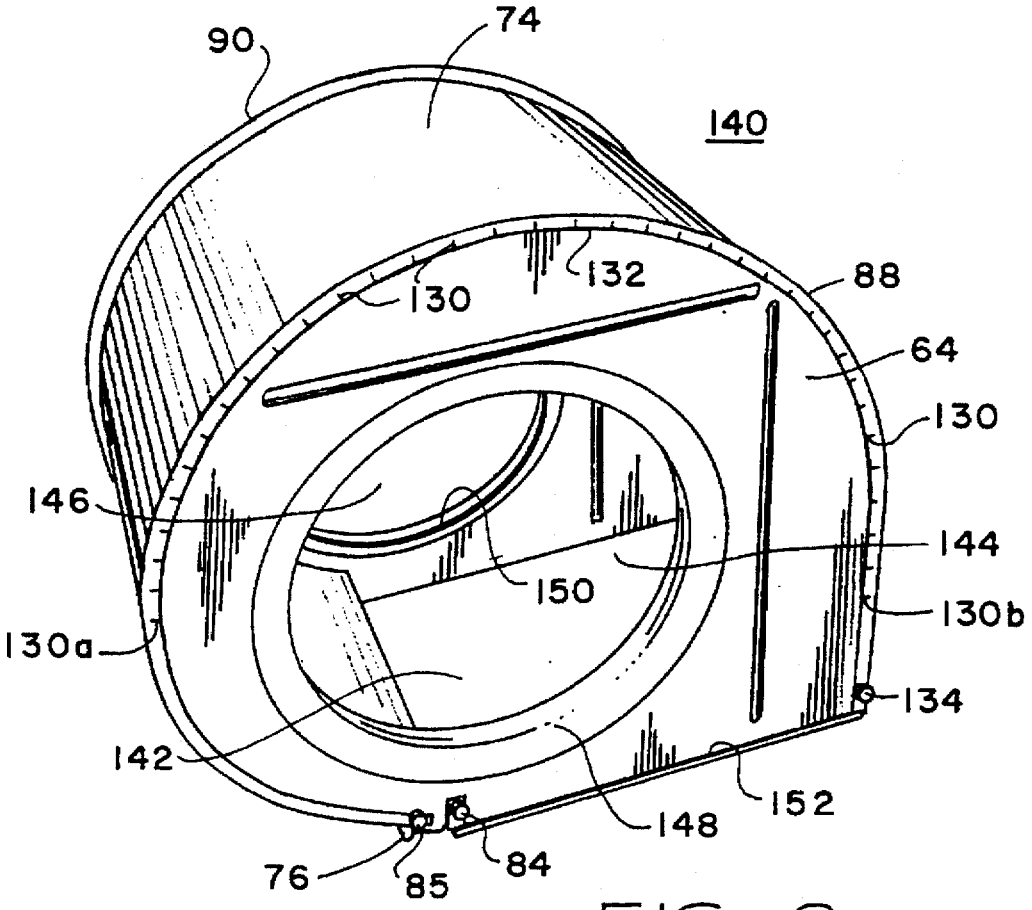
FIG. 8 is a perspective view of the fully assembled blower housing.
Figure 9:
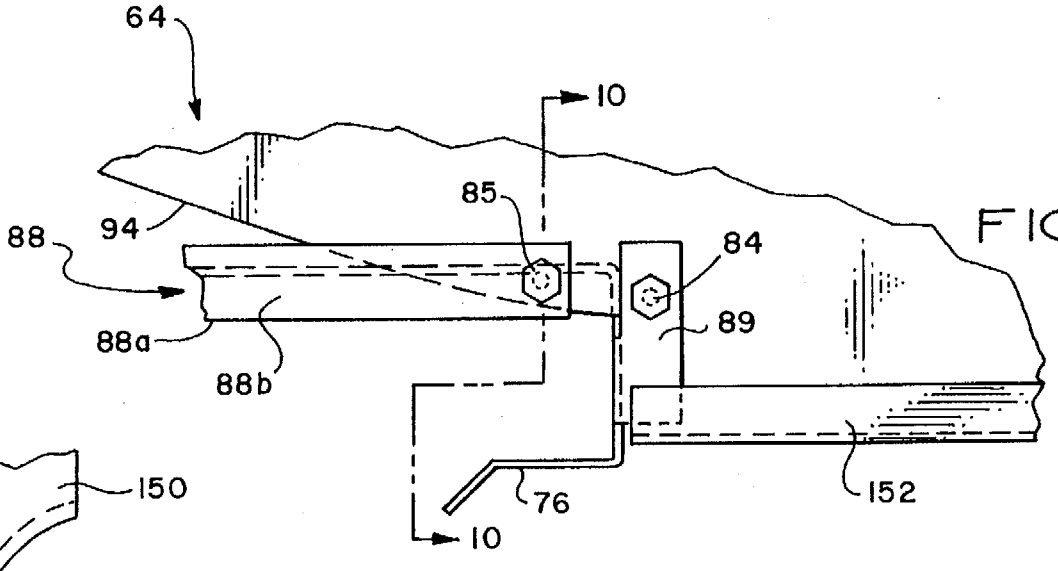
FIG. 9 is a detailed side view, showing the attachment of a wrapper panel to a scroll panel at the beginning of the blower assembly process.
Figure 10:
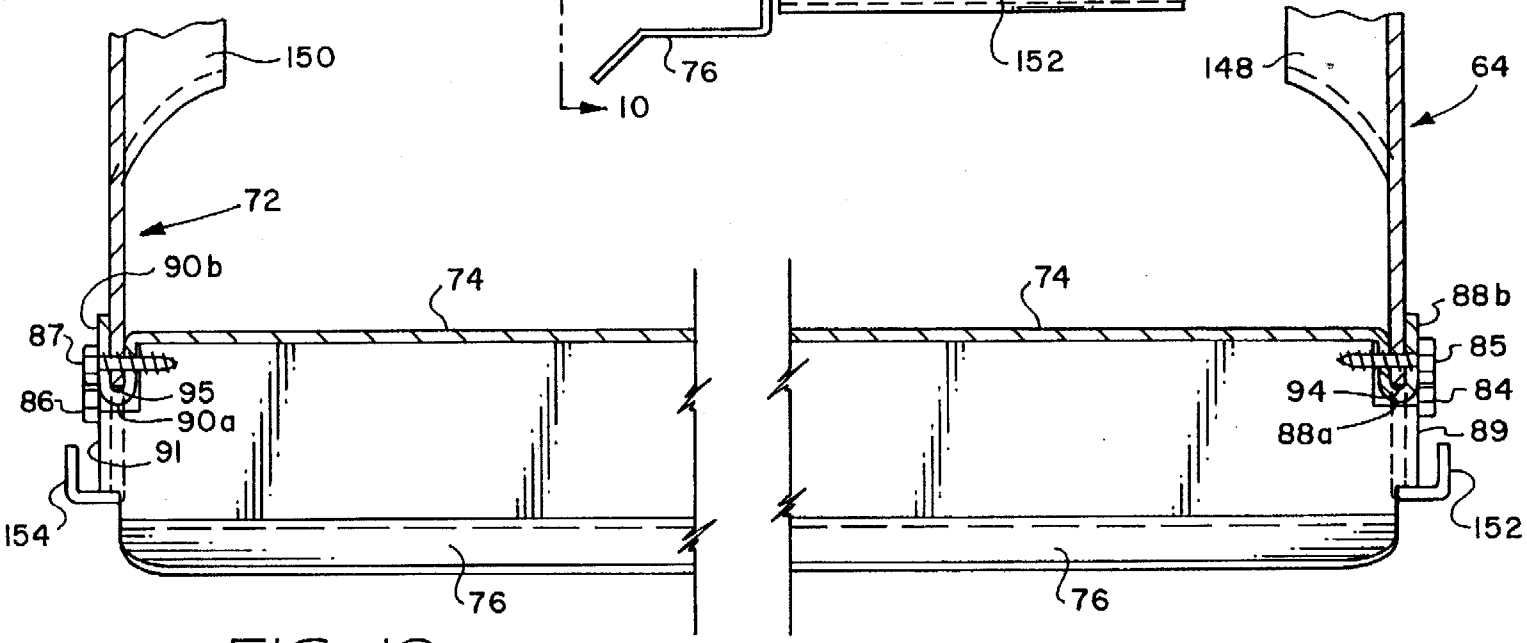
FIG. 10 is a sectional view, taken along the line 10—10 of FIG. 9.
Figure 11:
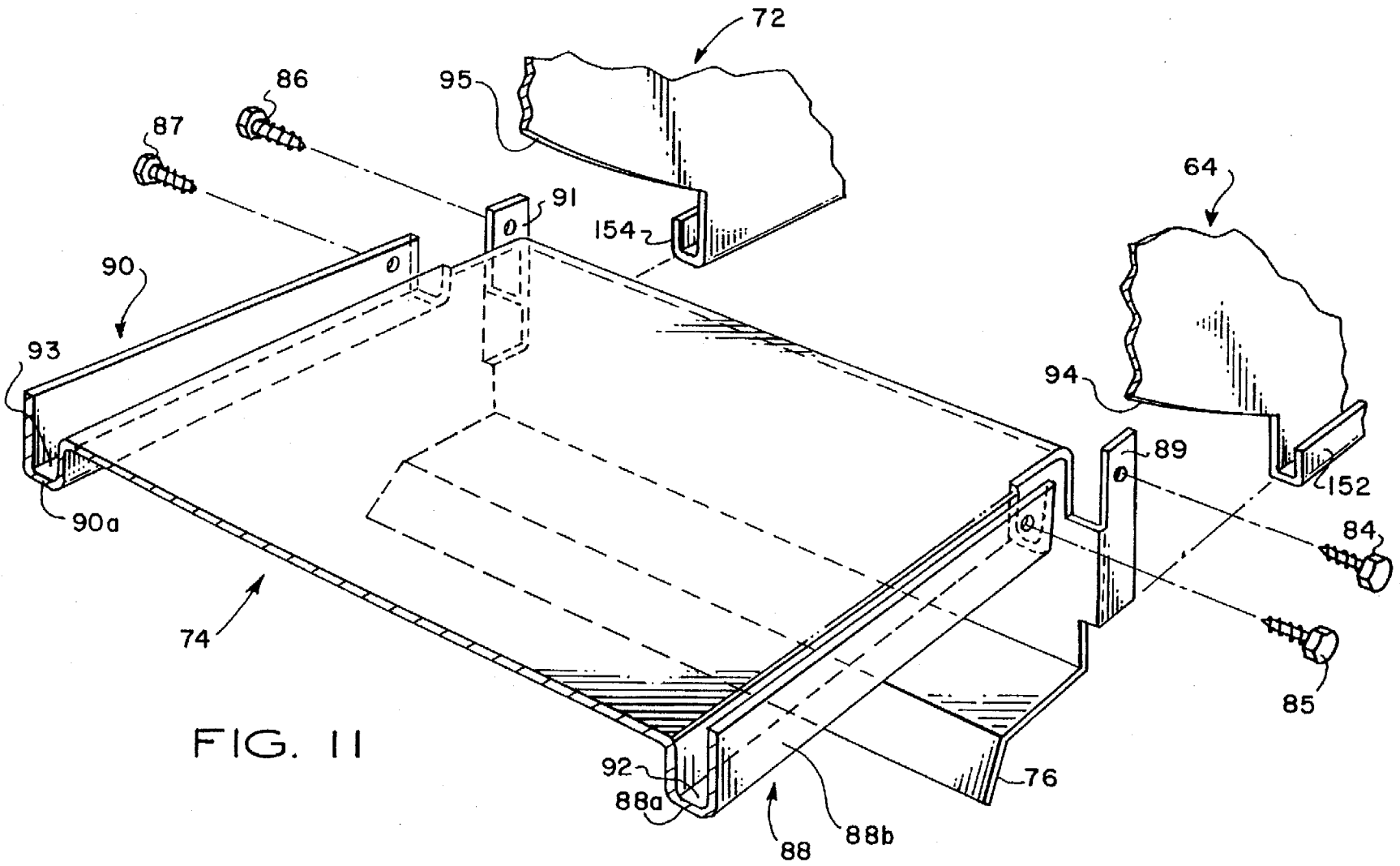
FIG. 11 is an exploded perspective view of portions of three panels used to assemble the blower housing.
Figure 12:
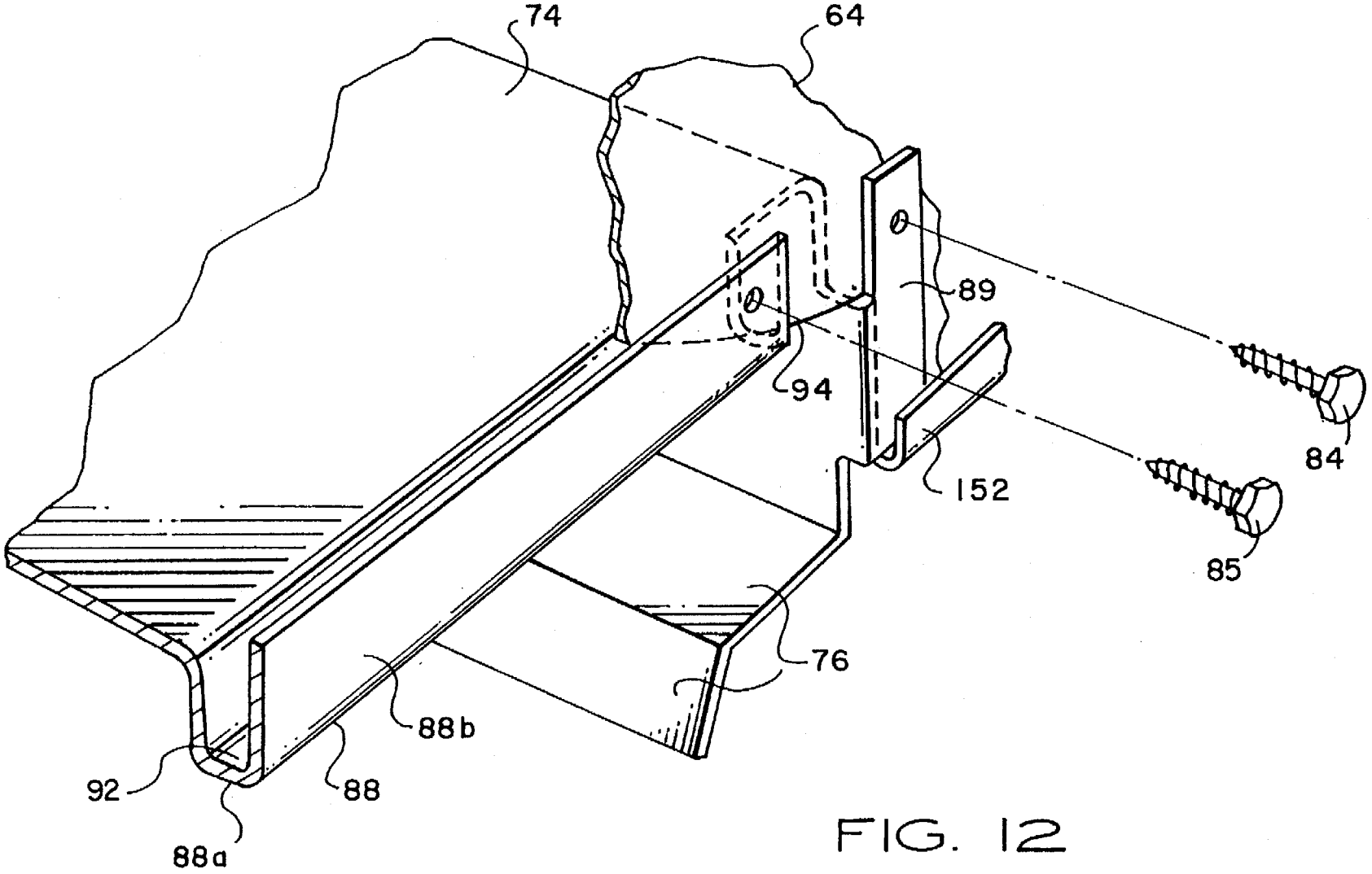
FIG. 12 is a perspective view, illustrating attachment of two of the panels.

Scoring marks 130 are spaced at approximately 0.875-inch intervals along flanges 88, 90. Scoring mark 130*a* is at a position corresponding to the onset of the scoring operation, as determined by the position of the aforementioned proximity switch. Scoring mark 130*b* is at a position corresponding to the end of the scoring operation, which coincides with the end of the wrapping cycle. The limit switch carried on stop member 44 (FIG. 2) is used to de-activate the hydraulic rotary actuator at the end of the wrapping cycle. Referring also to FIGS. 7 and 8, at the end of the wrapping cycle, two screws 134 (only one of which is shown) are used to attach third panel 74 to first and second panel 64, 72, proximate to the second end of third panel 74. One of the screws 134 attaches first flange 88 to first panel 64 and the other screw 134 attaches second flange 90 to second panel 72. After screws 134 are attached, pistons 98, 100 are retracted so that pistons 98, 100 are no longer in pressure engagement with flanges 88, 90. The hydraulic rotary actuator is then re-activated manually to rotate the wrapping mechanism in an opposite direction (i.e., counterclockwise, as viewed in FIG. 2) until cross-member 16 contacts the limit switch on stop member 42, whereupon the hydraulic rotary actuator is again de-activated until the onset of the next wrapping cycle.

As can be best seen in FIG. 8, the result of the assembly method described hereinabove is a housing 140 adapted to accommodate an air blower. Housing 140 has a bottom opening 142 and opposed side openings 144, 146. First panel 64 has a circumferential inwardly turned flange 148 surrounding opening 144 and second panel 72 has a circumferential inwardly turned flange 150 surrounding opening 146. Panels 64, 72 also have respective up-turned side flanges 152, 154. No screws or other attachment members are needed to secure third panel 74 to first and second panels 64, 72 between screws 85, 87 at the first end of third panel 74 and screws 134 at the second end thereof. In between, scoring marks 130 are sufficient to provide a secure joinder between third panel 74 and first panel 64 along seam 132 and between third panel 74 and second panel 72 along a corresponding seam (not shown).

It is believed that the improved blower housing and method of assembly thereof, according to the present invention, have fulfilled a long-felt need for a blower housing which is substantially resistant to vibration along the housing seams and for a faster, more economical assembly method. The scoring operation is effected concurrently with the wrapping operation, which reduces the number of steps in the assembly process. Further, the scoring operation according to the present invention provides improved seam connections between the major components of the blower housing, thereby reducing noise and vibration during blower operation.

The best mode for carrying out the invention has now been described in detail. Since changes in and modifications to the above-described best mode may be made without departing from the nature, spirit or scope of the invention, the invention is not to be limited to said details, but only by the appended claims and their equivalents.

I claim:

1. Apparatus for assembling first, second and third panels into a housing for an air blower, the first and second panels having respective first and second curved edges and the third panel having opposed first and second flanges, the first flange defining a first channel on one side of the third panel and the second flange defining a second channel on an opposite side of the third panel, said apparatus comprising:

retaining means for retaining the first and second panels in spaced parallel relationship with the third panel below the first and second panels;

wrapping means for wrapping the third panel around the first and second panels such that the first and second curved edges are received within the first and second channels, respectively, the first flange is in overlapping relationship with the first curved edge, the second flange is in overlapping relationship with the second curved edge and the third panel spans between the first and second panels; and securing means mounted with said wrapper means for securing said third panel to said first panel generally along said second paved edge and to said second panel generally along said second curved edge concurrently with the third panel being wrapped around the first and second panels.

2. Apparatus of claim 1 wherein said securing means includes scoring means for scoring the first flange at selected intervals therealong to secure the third panel to the first panel and for scoring the second flange at selected intervals therealong to secure the third panel to the second panel.

3. Apparatus of claim 2 wherein said securing means further includes first and second rollers and pressure means for holding said first roller in pressure engagement with an outwardly facing edge of the first flange and for holding said second roller in pressure engagement with an outwardly facing edge of the second flange.

4. Apparatus of claim 3 wherein said first roller has a reduced diameter first intermediate portion defining a first annular groove and said second roller has a reduced diameter second intermediate portion defining a second annular groove, said first annular groove being sized to receive the first flange and the first curved edge, whereby said first roller is guided along the first curved edge, said second annular groove being sized to receive the second flange and the second curved edge, whereby said second roller is guided along the second curved edge.

5. Apparatus of claim 4 wherein said first intermediate portion and said second intermediate portion are knurled for knurling the outwardly facing edge of the first flange and the outwardly facing edge of the second flange, respectively.

6. Apparatus of claim 4 wherein said scoring means includes plural first scoring members carried in said first roller and plural second scoring members carried in said second roller, said scoring means further including a first actuating member for sequentially actuating said first scoring members to impact the first flange at selected intervals therealong, said second scoring means further including a second actuating member for sequentially actuating said second scoring members to impact the second flange at second intervals therealong, said first scoring members being cooperative with said first roller to pinch the first flange against respective opposed sides of the first panel, said second scoring members being cooperative with said second roller to pinch the second flange against respective opposed sides of the second panel.

7. Apparatus of claim 6 wherein said first actuating member is a rotatable first cam and said second actuating member is a rotatable second cam, said first cam being located with respect to said roller such that said first scoring members contact said first cam in sequence as said first roller is rotated, each of said first scoring members being driven against the first flange by contact with said first cam, whereby the first flange is scored by said first scoring members, said second cam being located with respect to said second roller such that said second scoring members contact said second cam in sequence as said second roller is rotated, each of said second scoring members being driven against the second flange by contact with said second cam, whereby the second flange is scored by said second scoring members.

8. Apparatus of claim 6 wherein said first roller has first and second end portions and said second roller has third and fourth end portions, said first annular groove being between said first and second end portions and said second annular groove being between said third and fourth end portions, said first and second end portions being adapted to contact the first flange on respective opposed sides of the first panel, said third and fourth end portions being adapted to contact the second flange on respective opposed sides of the second panel.

9. A housing for an air blower, said housing comprising:

first and second panels in generally parallel relationship, said first and second panels having respective first and second curved edges; and a third panel having opposed first and second flanges, said first flange defining a first channel on one side of said third panel and said second flange defining a second channel on an opposite side of said third panel, said third panel being wrapped around said first and second panels such that said third panel spans between said first and second panels, said first and second curved edges being received within said first and second channels, respectively, said first flange being in overlapping relationship with said first curved edge and being in pressure engagement with respective opposed sides of said first panel, said second flange being in overlapping relationship with said second curved edge and being in pressure engagement with respective opposed sides of said second panel, said first flange being scored at selected intervals therealong proximate to a distal edge of said first flange to define a first seam along which said third panel is joined to said first panel, said second flange being scored at selected intervals therealong proximate to a distal edge of said second flange to define a second seam along which said third panel is joined to said second panel.

10. The housing of claim 9 wherein said first and second flanges are scored on respective outwardly facing surfaces thereof.

11. The housing of claim 10 wherein each of said first and second flanges has plural elongated scoring marks on the outwardly facing surface thereof.

12. The housing of claim 9 wherein said third panel is an elongated panel having opposed first and second ends, said housing further including at least one first attachment member and at least one second attachment member attaching said third panel to said first and second panels, respectively, proximate to said first end, said housing further including at least one third attachment member and at least one fourth attachment member attaching said third panel to said first and second panels, respectively, proximate to said second end, said third panel being joined to said first panel only by the scored first flange between said at least one first attachment member and said at least one third attachment member and being joined to said second panel only by the scored second flange between said at least one second attachment member and said at least one fourth attachment member.

13. The housing of claim 9 wherein said third panel is an elongated panel with opposed first and second ends, said housing including first and second attachment members attaching said third panel to said first panel proximate to said first end and third and fourth attachment members attaching said third panel to said second panel proximate to said first end, said housing further including a fifth attachment member attaching said third panel to said first panel proximate to said second end and a sixth attachment member attaching said third panel to said second panel proximate to said second end, said third panel being joined to said first panel between said second attachment member and said fifth attachment member only by the scored first flange and being joined to said second panel between said fourth and sixth attachment members only by the scored second flange.

* * * * *